US005620378A

United States Patent [19]

Fritz et al.

[11] Patent Number: 5,620,378

[45] Date of Patent: Apr. 15, 1997

[54] GOLF CLUB WITH INTEGRAL BALL STORAGE

[75] Inventors: Raymond J. Fritz, Maple Heights; Matthew R. Fuligni, Twinsburg, both of Ohio

[73] Assignee: The Little Tikes Company, Hudson, Ohio

[21] Appl. No.: 679,171

[22] Filed: Jul. 12, 1996

[51] Int. Cl.[6] ..... A63B 53/00; B65D 85/00; B65D 85/62

[52] U.S. Cl. ..... 473/282; 473/316; 473/324; 206/315.9

[58] Field of Search ..... 473/131, 316, 473/324, 282, 283, 284, 285, 132; 273/26 R, 26 B, 72 A; 446/475, 483, 75, 76; 206/315.1, 315.2, 315.9

[56] References Cited

U.S. PATENT DOCUMENTS

| | | | |
|---|---|---|---|
| 2,639,804 | 5/1953 | Merahn | 473/282 |
| 2,962,321 | 11/1960 | Fowler et al. . | |
| 3,115,342 | 12/1963 | Webster | 273/26 B |
| 3,943,989 | 3/1976 | Sperling | 206/315.9 |
| 4,040,229 | 8/1977 | Candor | 273/26 R |
| 4,088,251 | 5/1978 | Rodriguez . | |
| 4,538,810 | 9/1985 | Brophy . | |
| 4,676,397 | 6/1987 | Hoffmeister . | |
| 4,784,305 | 11/1988 | Schoenberg | 206/315.1 |
| 5,071,123 | 12/1991 | Spector | 446/76 |
| 5,368,191 | 11/1994 | Johnson . | |
| 5,472,189 | 12/1995 | Pfeiffer et al. . | |
| 5,558,226 | 9/1996 | Fritz | 446/75 |

OTHER PUBLICATIONS

P. 29, Golf club with ball storage; Today's Kids, Highway 10 East, Bonneville, Arkansas 72927. Publication date 1994.

P. 48, Golf club with ball storage; The Little Tikes Company, 2180 Barlow Road, Hudson, Ohio 44236. Publication date 1994.

*Primary Examiner*—Sebastiano Passaniti

*Attorney, Agent, or Firm*—Richard B. O'Planick; Lisa B. Riedesel

[57] ABSTRACT

A toy golf club (10) is disclosed comprising a handle (12), a hollow shaft (14), and a club head (16). The shaft (14) defines an internal ball magazine chamber (34) sized to receive and store multiple toy golf balls through an upper aperture (40). The balls are ejected one at a time through a lower aperture (42) that extends through a lower bevelled surface (45) at the heel portion of the head (16). Sequential ejection of the balls is controlled by a gate assembly (58) comprising a lower hood member (60) pivotally mounted to the bottom of the shaft (14) within the chamber (34); a linkage arm (62) connected at a lower end to the hood member (60) and extending within the shaft (14) to the handle (12); and a trigger member (64) that is attached to the upper end of the linkage arm (62) and projects through an opening (30) in the handle (12). Reciprocal upward and downward movement of the trigger member (64) pivots the hood member (60) between an open orientation wherein a ball can be ejected from the lower aperture (42) and a closed position in which the lower aperture ( 42 ) is obstructed.

19 Claims, 4 Drawing Sheets

GOLF CLUB WITH INTEGRAL BALL STORAGE

BACKGROUND OF THE INVENTION

1. Field of the Invention

The invention relates generally to golf clubs and, more specifically, toy golf clubs used by young children for indoor and outdoor play.

2. The Prior Art

Plastic golf sets are popular toys for young children. Typically the sets include one or more plastic molded club and one or more oversized balls that similate a golf ball in appearance. The plastic golf club is oversized to enable easy manipulation by a young child in striking the golf balls toward a target. In use, the child strikes the golf balls from a teeing area toward a plastic target. After the supply of balls is exhausted, the child retrieves the balls from the target area and returns them to the same or a different teeing area from which to resume play.

While the aforementioned state of the art golf sets work well and are popular consumer items, certain deficiencies which attend their use make them less desirable from a user's standpoint. First, the retrieval of multiple balls by a young child from the target area back to a teeing area is cumbersome given the size of the balls and the small hands of the child. It is difficult for a young child to collect a number of oversized balls and carry them without dropping some or all of the balls. When carrying the golf club along, the task becomes even more difficult.

Secondly, once the golf set is used and its packaging distroyed, storage of the golf set is likewise cumbersome. The multiple balls often become lost or misplaced when stored in loose form apart from the golf club and target. At the least, collection of the items from a storage location in order to initiate play is time consuming and cumbersome causing a level of dissatisfaction in the user.

Lastly, conventional golf sets are made by numerous manufacturers that comport with the aforementioned discription and have become, therefore, somewhat of a nondescript commodity item lacking in originality and enhanced play value. Without such enhanced or unique play value, the interest of the child in playing the game usually wanes quickly.

SUMMARY OF THE INVENTION

The subject invention overcomes the aforementioned deficiencies in state of the art toy golf sets. A club is provided having an integral internal magazine chamber for storage of multiple oversized golf balls. The balls are inserted at the top of the club shaft and exit from a bottom aperture. A trigger actuated gate controls the opening and closing of the bottom aperture such that the balls in the storage magazine may be discharged one at a time. The configuration of the shaft is such that the balls can be ejected from the magazine while the club head is at rest on the ground, making the ejection convenient and easy for young children. The integral storage capablity of the club makes retrieval and return of balls easy to accomplish for young users and makes storage and retrieval of the game easy and space efficient. Moreover, ejection of the balls from the magazine chamber adds play quality to the system, increasing the interest level of the child and thereby enhancing the long term appeal of the toy.

Accordingly, it is an objective of the present invention to provide a toy golf set having means for conveniently and easily enabling a young user to retrieve and transport multiple oversized golf balls.

A further objective is to provide a toy golf set that stores in a compact and easily retrievable form.

Still another objective is to provide a toy golf set that provides integral storage of multiple golf balls and means for easily and conveniently ejecting the balls one at a time on demand.

Another objective is to provide a toy golf set that provides a golf club having integral storage of multiple golf balls and means actuatable by youthful users from the handle location of the golf club with the golf club head at rest upon the ground.

A further objective is to provide a toy golf set that has integral multiple golf ball storage that is inexpensive the manufacture and which provides enhanced user interest and quality of play appeal.

These and other objectives, which will be apparent to those skilled in the art, are achieved by a preferred embodiment that is described in detail below and illustrated by the accompanying drawings.

DESCRIPTION OF THE ACCOMPANYING DRAWINGS

DESCRIPTION OF THE PREFERRED EMBODIMENT

Figure 1:
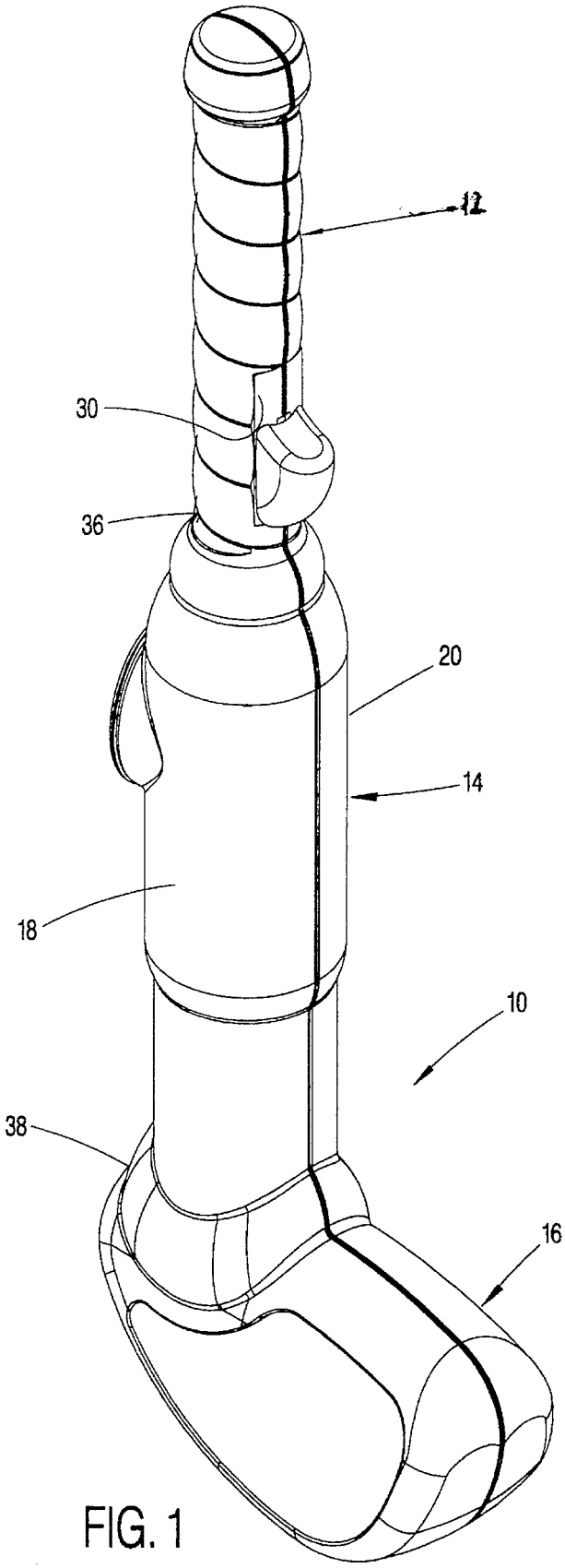
FIG. 1 is a front perspective view of the subject golf club.
Figure 2:
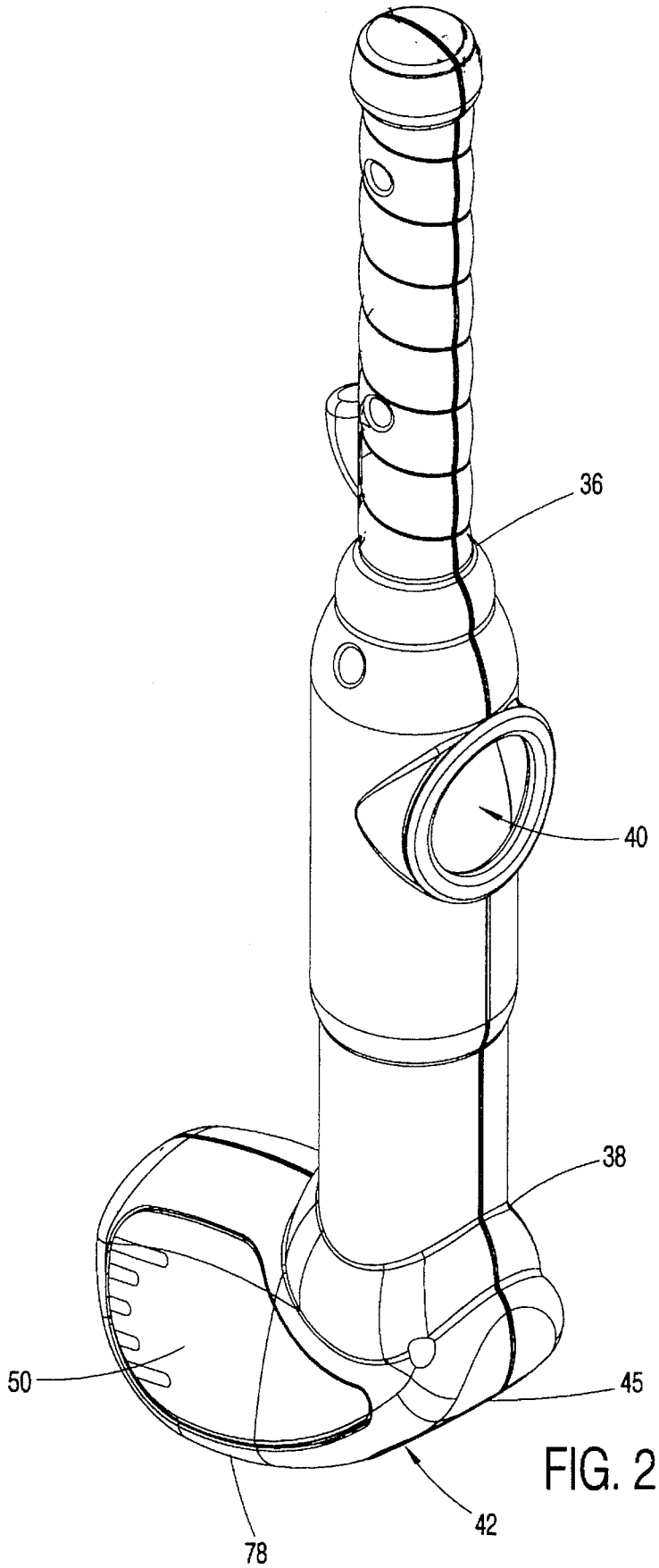
FIG. 2 is a rear perspective view thereof.
Figure 3:
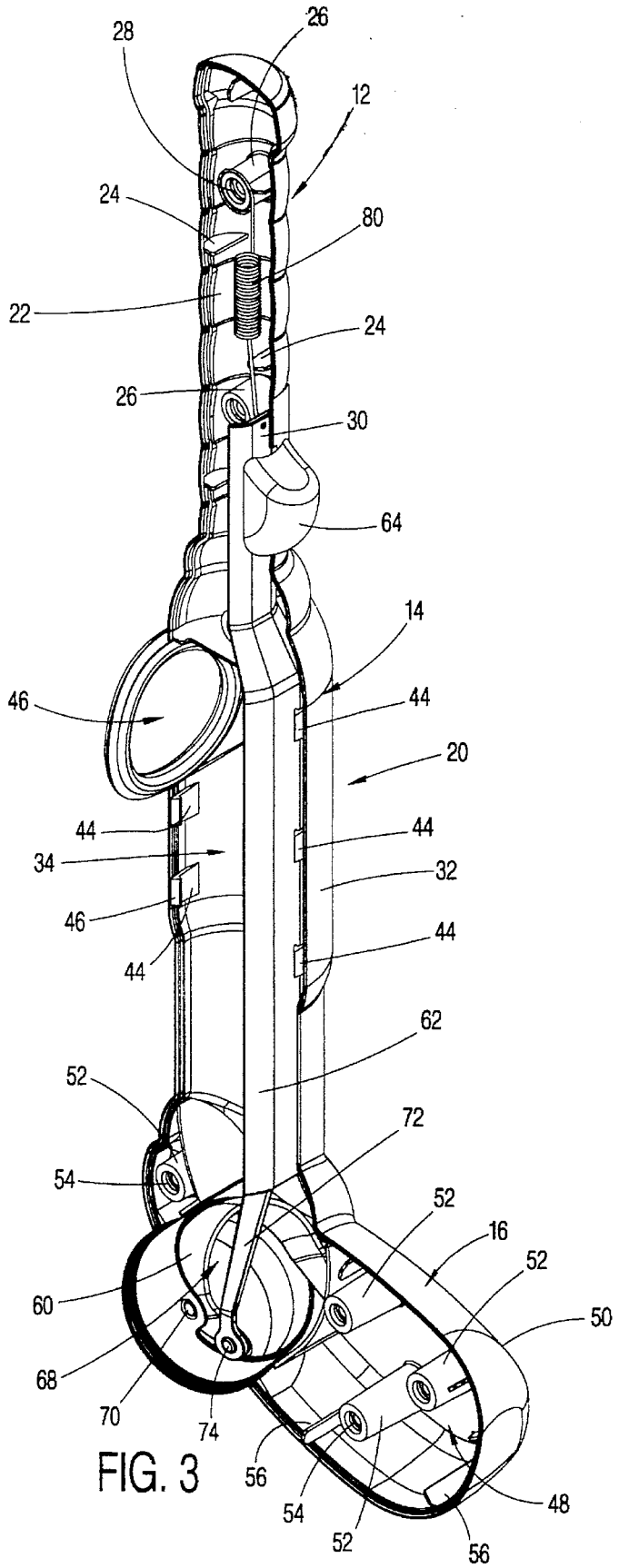
FIG. 3 is a front perspective view of a right half-section of the golf club.
Figure 4:
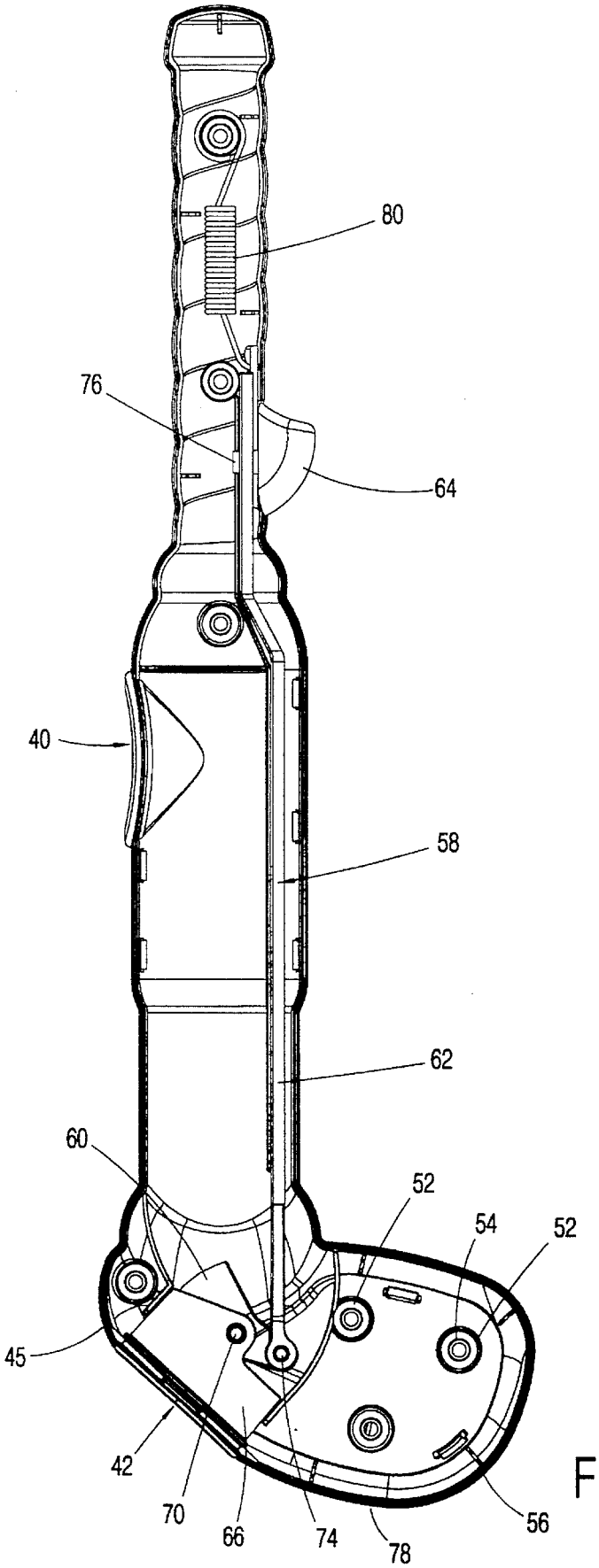
FIG. 4 is a side elevation view of the right half-section of the golf club.

Referring collectively to FIGS. 1–4, the subject invention comprises in the preferred embodiment a golf club 10 having a cylindrical, hand sized handle portion 12, an elongate cylindrical shaft 14, and a hollow club head 16 at the bottom end of the shaft 14. The club 10 is formed in two half-sections 18, 20 of plastics material such as polypropylene by conventional injection molding process. The two sections 18, 20 are assembled in a post mold operation to form the complete unit depicted in FIGS. 1 and 2. The club 10 is symmetrical about a vertical centerline which comprises the boundary line between sections 18, 20. For the purpose of the subject disclosure, section 20 will be described in detail, it being understood that section 18 is essentially a mirror image thereof.

The handle 12 is of cylindrical configuration, having a hollow core 22 and a convoluted exterior surface that simulates the grip of a conventional golf club. Projecting into the core 22 from the sidewalls of handle 12 are spacer flanges 24. Two elongate cylindrical sockets 26 project into the core 22; each socket having an inwardly extending axial bore 28. It will be appreciated that the sockets 26 of the section 20 receive complimentarily positioned posts projecting from the handle of section 18 in a post-mold operation to connect the two handle sections together. A rectangular opening 30 is presented along a forward edge of the section 20 that, in conjunction with a like-positioned opening in section 18 forms an opening receiving the ball discharging trigger mechanism therethrough in a manner explained below.

The shaft 14 is configured having substantially cylindrical sidewalls 32 that define an internal elongate ball magazine chamber 34 extending axially along substantially the entire length of the shaft 14 from an upper end 36 to a lower end 38. An upper, rearwardly located, circular portal or aperture 40 extends through the sidewalls 32 and communicates with chamber 34. A lower, rearwardly positioned aperture 42 is provided at the lower end of the shaft and extends through a bevelled surface 45 which is located at the heel of the head 16. Surface 45 is angled downward toward a forward portion of the club head 16 and generally blocks off the lower end of the chamber 34. The aperture 42 extends through the surface 45 and likewise communicates through the surface 45 with the chamber 34.

Cantilever latch flanges 44, each of which having a locking tab 46 along a remote terminal edge, project from the edges of the sidewalls 32 of section 20 and engage through sockets (not shown) suitably located in section 18 to lock the sections 18,20 together in a post-mold assembly procedure. The chamber 34 is of circular sectional configuration, diametrically dimensioned to accomodate the receipt and housing of multiple oversized toy golf balls therein. The upper aperture 40 is dimensioned to allow close insertion of the balls therethrough into the chamber 34 and the aperture 42 is dimensioned to allow the balls to egress from the chamber 34 one at a time at the lower end.

The golf club head 16 is of hollow configuration, comprising a hollow core 48 and having a substantially flat forward face 50 for striking a toy golf ball. Four spaced apart, elongate cylindrical sockets 52 project from the sides of the head into the core 48, each socket having an axial bore 54 extending therein. The sockets 52 of the section 20 receive complimentarily located posts extending from section 18 during assembly of the sections to attach the head portions of each section together. Spacer reinforcement flanges 56 project from the head sidewalls into the core 48.

A gate assembly 58 is positioned within the shaft 14, comprising a lower U-shaped hood member 60, an elongate linkage arm 62, and an upper actuation trigger 64. A fixed support socket member 66 is positioned at the bottom of the shaft 14 at the heel of the head 16. Socket member 66 is pitched at an angle, aligned with the lower aperture 42. The hood member 60 defines a central circular passageway 68 and is pivotally seated within the socket member 66 by outwardly projecting pivot posts 70 which extend from the member 60 through the socket member 66. So seated, the hood member can rotate into an upright orientation in which the member 60 is positioned between the chamber 34 and the aperture 42, and obstructs the lower chamber aperture 42. This configuration is referred to as the "closed" position. Alternatively, the hood member 60 may be rotated into an inverted condition in which the passageway 68 coaligns with the socket member 66, the aperture 42, and the chamber 34. This is referred to as the "open" configuration.

The linkage arm 62 has a yoke portion 72 at a lower end, with terminal ends of the arms of the yoke portion 72 affixed to opposite ends of the hood member 60 by rivets 74. Linkage arm 62 resides within the sidewalls 32 of the shaft 14 and extends upward to the the handle 12. The trigger member 64 is affixed to the upper end of the linkage arm 62 by stake 76 and projects therefrom through the rectangular forward opening 30 in the handle 12. So positioned, the trigger member 64 can be digitally moved upward and downward withing the opening 30, and thereby move the linkage arm 62 upward and downward in reciprocal fashion. Axial movement of the linkage arm 62 is applied to the hood member 60 by the yoke 72 and translates into pivotal movement of the hood member 60 between the open and closed configurations.

It will be appreciated that a plurality of oversized toy golf balls may be fed through aperture 46 and into the magazine chamber 34. There, the balls can be stored within the club between play, saving space and keeping the balls in a fixed and organized location. The loss of balls between play is thereby minimized. Moreover, the balls in the stored condition do not become separated from the club and do not occupy any additional storage space. The magazine preferably will accomodate three or four golf balls.

During play, the balls are ejected from the magazine chamber 34 one by one from the bottom aperture 42 by actuation of the trigger member 64. Upward movement of trigger 64 opens the hood member 60 so that one ball may be ejected, and subsequent downward movement of the trigger 64 closes hood member 60 to keep the remaining balls within the chamber. The actuation of trigger 64 can be accomplished while grasping handle 12, making it possible for young children to retain control of the club while effecting an ejection of a ball.

The bevelled surface 45 at the heel of the club head 16 elevates the lower aperture 42 a sufficient distance above the lower edge 78 of the head 16 so that the ejected ball can clear the aperture 42 and escape to the ground while the head edge 78 is on the ground or floor. This stablilizes the club and enables the young user to manipulate the trigger member 64 and eject a ball while the club is supported at the bottom. After the ball is ejected, it is placed into play in customary fashion by striking it toward a target by club head face 50.

After all the balls are ejected and propelled toward the target, the subject invention provides the youthful user with the means to readily and conveniently gather and store the balls at the target area for transport back to the original teeing area or to a new teeing area. Because the toy golf balls are intended to be oversized, simultaneous transport of the balls by small hands would otherwise be impossible or cumbersome at best.

The subject invention further provides enhanced play value in the operation of the storage chamber and trigger ejection mechanism. A child's interest level in the operation of the subject toy golf club will accordingly be higher than with conventional toy golf clubs.

Thus, the subject invention provides a combined club and ball storage device that facilitates easy storage of multiple balls between uses, easy retrieval and transportation of golf balls between locations during use, and enhanced play value.

While the above describes the preferred embodiment of the subject invention, the invention is not intended to be so confined. Other embodiments which will be apparent to those skilled in the art and which use the teachings herein set forth are intended to be within the scope ant spirit of the invention.

We claim:

1. A golf club and ball storage device, comprising:

an elongate club shaft having an upper handle portion, an intermediate shaft segment, and a lower end;

the shaft intermediate segment comprising sidewalls and an internal ball magazine chamber extending axially along the shaft segment, and a first opening extending through the sidewalls at an upper end of the shaft intermediate segment in communication with the chamber and sized to admit a ball therethrough and into the chamber, and a second opening extending through the segment sidewalls at a lower end of the shaft intermediate segment in communication with the chamber and sized to permit egress of a ball therethrough; and a club head affixed to the lower end of the club shaft for striking a ball.

2. A device according to claim 1, wherein the shaft intermediate segment sidewalls comprise a downwardly directed terminal surface through which the second opening extends and that is positioned rearward of the club head and encloses a lower end of the magazine chamber.

3. A device according to claim 2, wherein the terminal surface is located above a lower edge of the club head a distance sufficient to allow one discharged ball to freely emerge from the terminal surface with the lower edge of the club head at rest upon a horizontal support surface.

4. A device according to claim 3, wherein the terminal surface is bevelled downward and inward toward the club head.

5. A device according to claim 4, wherein the magazine chamber has an internal sectional dimension substantially equivalent to the diameter of a ball.

6. A device according to claim 5, wherein the handle portion has a cross-sectional diameter less than a cross-sectional diameter of the shaft intermediate segment.

7. A device according to claim 1, wherein further comprising gate means mounted to the shaft proximate the lower shaft end for selectively closing and opening the second opening.

8. A device according to claim 7, wherein the gate means comprises a pivotally mounted door member that pivots between a closed position in which the door member obstructs the second opening and an open position in which the second opening is unobstructed by the door member; and user controlled actuating means for moving the door member between the closed and open positions.

9. A device according to claim 8, wherein the actuating means comprises an elongate linkage arm that extends axially along the shaft intermediate segment and is connected at a lower end to the door member and reciprocally moves upward and downward to pivot the door member between the closed and open positions, and the linkage arm has a user actuated upper end portion positioned proximate the shaft handle portion that activates the reciprocal upward and downward movement of the linkage arm.

10. A device according to claim 9, wherein the door member and the linkage arm are enclosed by the shaft intermediate segment sidewalls.

11. A golf club and ball storage device, comprising:

an elongate club shaft having an upper handle portion, an intermediate shaft segment, and a lower end; the shaft intermediate segment comprising sidewalls and an internal ball magazine chamber extending axially along the shaft segment, and a first opening extending through the sidewalls at an upper end of the shaft intermediate segment in communication with the chamber and sized to admit a ball therethrough and into the chamber, and a second opening extending through the segment sidewalls at a lower end of the shaft intermediate segment in communication with the chamber and sized to permit discharge of a ball therethrough; and a club head affixed to the lower end of the club shaft for striking discharged ball; and gate means mounted within the shaft intermediate segment proximate the lower shaft end for selectively closing and opening the second opening.

12. A device according to claim 11, wherein the gate means comprises a pivotally mounted door member that pivots between a closed position in which the door member obstructs the second opening and an open position in which the second opening is unobstructed by the door member; and user controlled actuating means for moving the door member between the closed and open positions.

13. A device according to claim 12, wherein the actuating means comprises an elongate linkage arm that extends axially within the shaft intermediate segment and is connected at a lower end to the door member and reciprocally moves upward and downward within the shaft intermediate segment to pivot the door member between the closed and open positions, and the linkage arm has a user actuated upper end portion positioned proximate the shaft handle portion that initiates the reciprocal upward and downward movement of the linkage arm.

14. A device according to claim 13, wherein the upper end portion of the linkage arm projects through the sidewalls of the shaft intermediate segment and is digitally accessible by the user from the handle portion.

15. A device according to claim 14, wherein the shaft intermediate segment sidewalls comprise a downwardly directed terminal surface through which the second opening extends and that is positioned rearward of the club head and encloses a lower end of the magazine chamber.

16. A device according to claim 15, wherein the terminal surface is located above a lower edge of the club head a distance sufficient to allow a discharged ball to freely emerge from the terminal surface with the lower edge of the club head at rest upon a horizontal play surface.

17. A device according to claim 16, wherein the terminal surface is bevelled downward and inward toward the club head.

18. A device according to claim 17, wherein the magazine chamber has an internal sectional dimension substantially equivalent to the diameter of a ball.

19. A device according to claim 18, wherein the handle portion has a cross-sectional diameter less than a cross-sectional diameter of the shaft intermediate segment.

* * * * *